US012219991B1

(12) United States Patent
Reta

(10) Patent No.: US 12,219,991 B1
(45) Date of Patent: Feb. 11, 2025

(54) CIGAR HOLDERS

(71) Applicant: Adolfo Reta, Garden Grove, CA (US)

(72) Inventor: Adolfo Reta, Garden Grove, CA (US)

( * ) Notice: Subject to any disclaimer, the term of this patent is extended or adjusted under 35 U.S.C. 154(b) by 1 day.

(21) Appl. No.: 18/349,341

(22) Filed: Jul. 10, 2023

Related U.S. Application Data

(60) Provisional application No. 63/359,711, filed on Jul. 8, 2022.

(51) Int. Cl.
*A24F 13/12* (2006.01)
*A24F 13/24* (2006.01)
*F23D 14/38* (2006.01)

(52) U.S. Cl.
CPC ..... *A24F 13/12* (2013.01); *A24F 13/24* (2013.01); *F23D 14/38* (2013.01)

(58) Field of Classification Search
None
See application file for complete search history.

(56) References Cited

U.S. PATENT DOCUMENTS

2007/0000502 A1* 1/2007 Chong ..... A24F 15/18 131/249

* cited by examiner

*Primary Examiner* — Michael J Felton
(74) *Attorney, Agent, or Firm* — Miller IP Law; Devin Miller

(57) ABSTRACT

Described herein are examples of a cigar holders. The cigar holder can include a cigar tube configured for holding a cigar, an attachment arm and a lighter frame configured to receive a lighter. The cigar holder can further include a magnet configured to secure the cigar holder to a metal structure, such as a pole, bumper, or vehicle. The cigar holder can further include a punch configured to cut the cigar.

20 Claims, 5 Drawing Sheets

CIGAR HOLDERS

CROSS-REFERENCE TO RELATED APPLICATIONS

The present application claim priority to U.S. Provisional Patent Application No. 63/359,711 entitled "CIGAR HOLDER WITH LIGHTER AND PUNCH", filed on Jul. 8, 2022. The entire contents of the above-listed application are hereby incorporated by reference for all purposes.

BACKGROUND

Ashtrays and other devices designed for holding lit cigarettes and/or cigars have been manufactured in various shapes and configurations. Ashtrays are employed to hold lit cigarettes or cigars prior to lighting, after they have been lit and can be used to extinguish the cigarette or cigar after smoking. Lighters and/or matches have been used for lighting cigarettes or cigars.

BRIEF DESCRIPTION OF THE DRAWINGS

The present description will be understood more fully when viewed in conjunction with the accompanying drawings of various examples of cigar holders. The description is not meant to limit the cigar holders to the specific examples. Rather, the specific examples depicted and described are provided for explanation and understanding of cigar holders. Throughout the description the drawings may be referred to as drawings, figures, and/or FIGs.

DETAILED DESCRIPTION

Cigar holders as disclosed herein will become better understood through a review of the following detailed description in conjunction with the figures. The detailed description and figures provide merely examples of the various embodiments of cigar holders. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

Conventional cigar holders such as cases or ashtrays can include a cut-out to rest the cigar on the side of the case or ashtray. The conventional holders can further include a clamp device, such as a cloth pin.

Cigar holders have not been designed to hold cigars in moving vehicles, such as cars, boats, or golf carts. Additionally, conventional cigar holders do not include lighters or punches to cut the cigar.

Implementation of cigar holders according to the present invention may address some or all of the problems described above. The cigar holder can include a lighter temporarily or permanently attached to the cigar holder. Additionally, the cigar holder can include a punch to cut the cigar prior to lighting.

The cigar holder can further include a magnet, such as a high-powered magnet, to secure the cigar holder to a structure or vehicle. Examples of metal structures which the magnet can be secured to include metal poles, chairs, bumpers, golf car frames, boat frames, and similar metal structures and/or vehicles. Combining the cigar holder, lighter, and punch into a single device avoids issues related to losing, misplacing, or separating the individual components.

Figure 1:
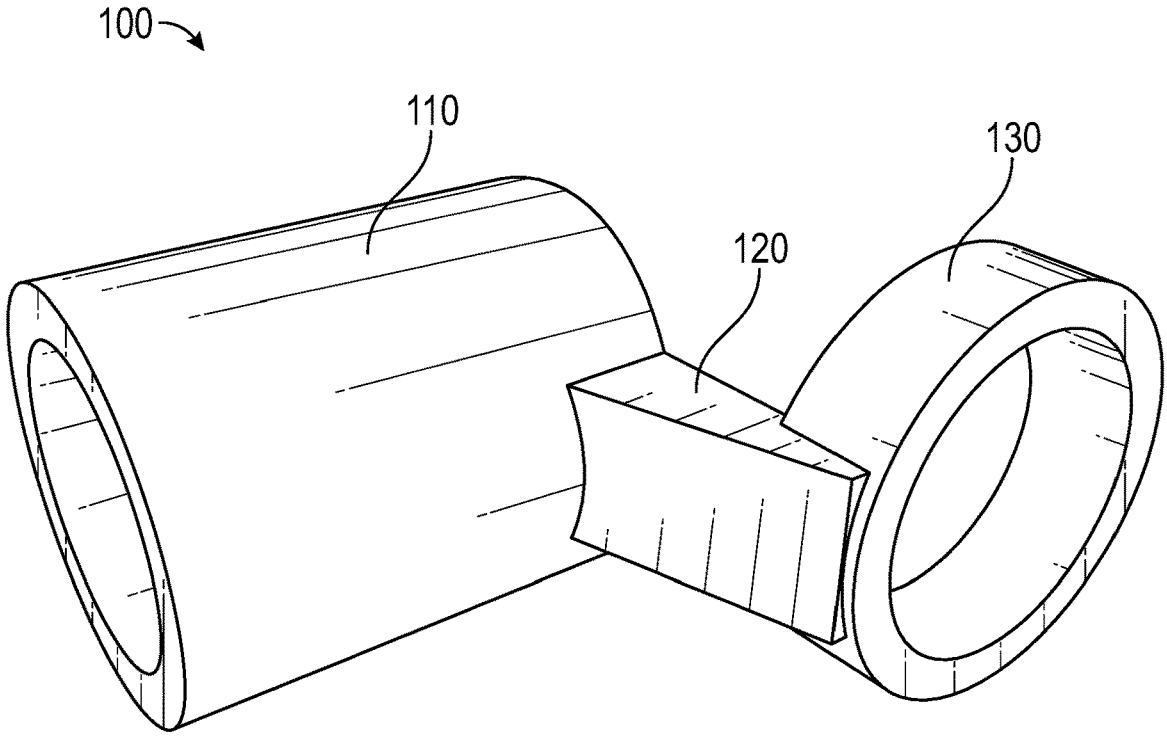
FIG. 1 illustrates a cigar holder, according to an embodiment.

FIG. 1 illustrates a cigar holder 100, according to an embodiment. FIG. 1 illustrates an embodiment of the cigar holder 100 including a cigar tube 110, an attachment arm 120, and a lighter frame 130. Embodiments of the cigar tube 110 are generally cylindrical with an inner diameter and an outer diameter. The attachment arm 120 is configured to join the cigar tube 110 and the lighter frame 130. Embodiments of the cigar holder 100 include an attachment arm 120 extending generally perpendicular to the vertical length of the cigar tube 110 and the lighter frame 130. Embodiments of the lighter frame 130 can be a circular frame configured to hold an end of a cigar lighter, such as a torch, butane, or propane lighter. The configuration of the bottom of the cigar tube 110, the attachment arm 120 and the lighter frame 130 can be designed to hold the lighter (not shown).

Figure 2:
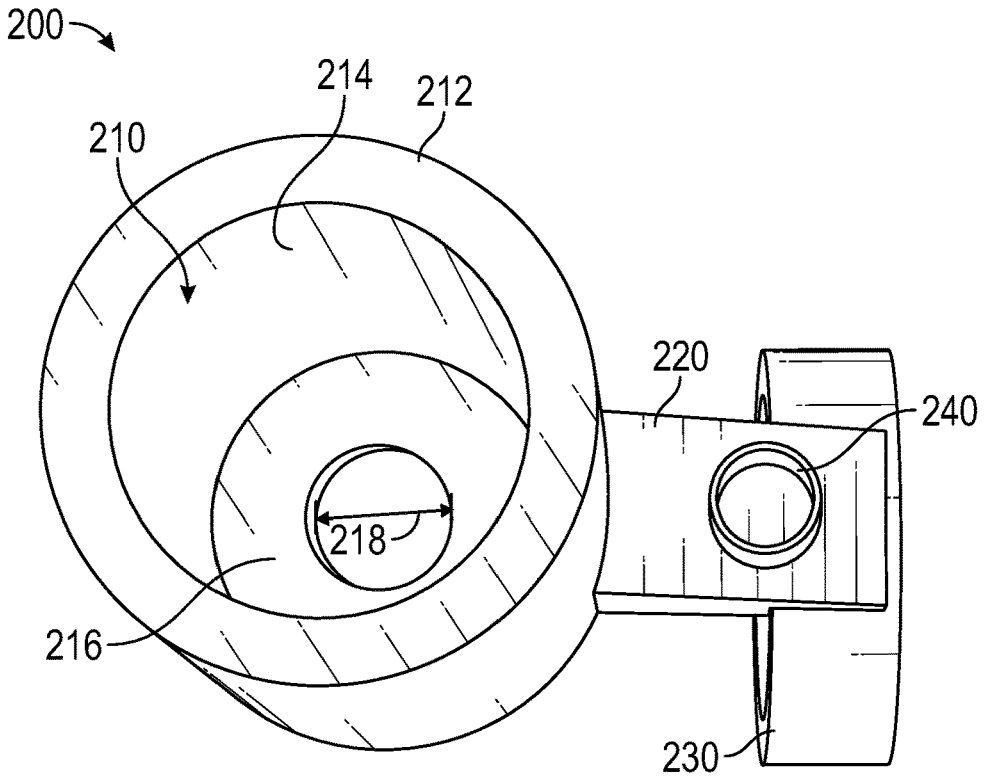
FIG. 2 illustrates a cigar holder, according to an embodiment.

FIG. 2 illustrates a cigar holder 200, according to an embodiment. The cigar holder 200 illustrated in FIG. 2 is depicted at a 45-degree angle. The cigar holder 200 includes a cigar tube 210, an attachment arm 220, and a lighter frame 230. The lighter frame 230 further includes a punch 240 configured for cutting the end of a cigar to facilitate lighting the cigar (not shown).

The cigar tube 210 includes a cigar tube outer wall 212 and a cigar tube inner wall 214. The embodiment disclosed in FIG. 2 has a cigar tube 210 with an inner diameter of approximately 2.6 cm (the diameter measured from an edge of the inner wall 214 to an opposite edge of the inner wall 214) and an outer diameter of approximately 3.5 cm (the diameter measured from an edge of the outer wall 212 to an opposite edge of the outer wall 212). Embodiments can include an inner diameter ranging from 1 cm to 5 cm, between 2 cm and 3 cm, and between 2.25 and 2.75 cm. Embodiments can include an outer diameter between 2 and 7 cm, between 3 and 6 cm, and between 3.25 cm and 3.75 cm. The cigar tube 210 further includes a cigar tube inner base 216 and a cigar tube base aperture 218. In one embodiment, the top portion of the cigar tube 210 opposite the cigar tube base aperture 218, may be configured to receive a reducing device that may be permanently or removably connected to at least a portion of the inner wall to reduce at least a portion of the inner diameter range. The reducing device may be inserted or attached to the cigar tube 210 to adjust at least a portion of the inner diameter to receive a cigar with a diameter less than the inner diameter of the inner wall 214 when the reducing device is not attached or inserted. The cigar tube base aperture 218 is configured to allow heat to dissipate from a lit cigar (not shown) allowing the cigar to breathe and to avoid introducing excessive heat to the lighter (not shown). The cigar tube base aperture 218 is generally circular, but can be configured in different shapes, such as squares, rectangles, stars, or other shapes. The cigar tube base aperture 218 can have multiple openings in various shapes to allow passage of air and heat. Embodiments of the cigar tube base aperture 218 can have a diameter between 2 and 0.25 cm, between 1.5 and 0.5 cm, and between 1 and 0.75 cm.

FIG. 2 further depicts a punch 240 disposed on the attachment arm 220. Embodiments of the punch can include a raised circular structure configured to punch or cut the end of a cigar. A user can push an end of the cigar into the punch 240 thereby cutting and/or perforating an end of the cigar to be lit and smoked. The punch 240 can be generally circular or configured in different shapes, including square, rectangles, stars, spikes, or other shapes configured to puncture an end of a cigar. Embodiments of the punch can have a vertical height (measured from the attachment arm 220) between 0.1 and 1 cm, between 0.2 and 0.75 cm, between 0.3 and 0.5 cm. Embodiments of the punch 240 can have a diameter (or horizontal width) between 0.1 and 1 cm, between 0.2 and 0.75 cm, between 0.3 and 0.5 cm.

Figure 3:
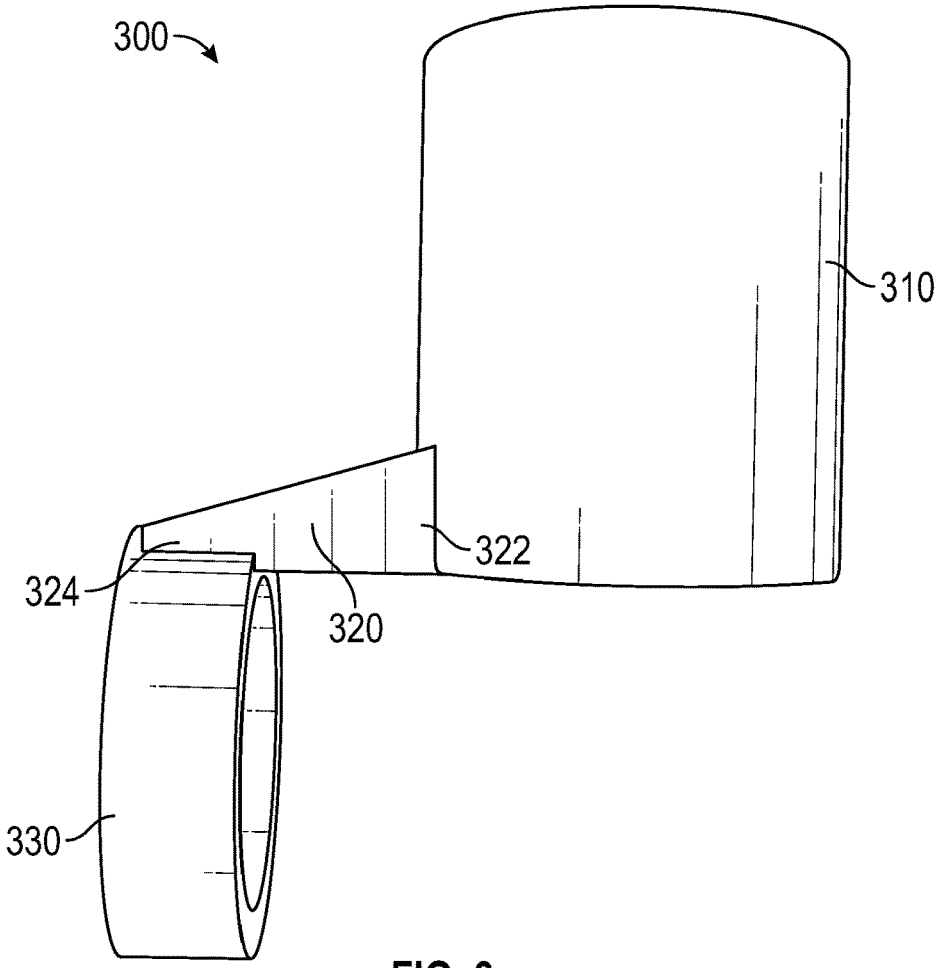
FIG. 3 illustrates a cigar holder, according to an embodiment.

FIG. 3 illustrates a cigar holder 300 according to an embodiment. The cigar holder 300 illustrated in FIG. 3 is an embodiment in which the vertical height of the cigar holder 300 is approximately 8.3 cm. Embodiments of the cigar holder 300 can have a vertical height between 4 and 15 cm, between 6 and 12 cm, and between 7 and 9 cm. The vertical height of the cigar holder 300, according to an embodiment, include the vertical height of the cigar tube 310, the attachment arm 320, and the lighter frame 330. The attachment arm 320 as depicted in FIG. 3 is generally triangular with a larger attachment arm base 322 connected or affixed to the cigar tube 310 and a narrower attachment arm edge 324 connected or affixed to the lighter frame 330. The attachment arm 320 can be triangular, square, rectangular or any shape that connects the cigar tube 310 to the lighter frame 330. The attachment arm 320 can have a horizontal length between 2 and 10 cm, between 3 and 8 cm, and between 4 and 6 cm. Embodiments can be 3, 4 or 5 cm in length. The width of attachment arm 320 (measured perpendicular to the horizontal length) can be between 0.10 and 2 cm, between 0.25 and 1.5 cm, and between 0.5 and 1 cm. The vertical height of the attachment arm 320 can be between 0.25 and 2 cm, between 0.5 and 1.5 cm, and between 0.75 and 1 cm. In embodiments where the attachment art is generally triangular, the vertical height can vary from the attachment arm edge 324 to the attachment arm base 322.

The lighter frame 330 can be generally cylindrical and/or circular. The lighter frame 330 can be configured to hold an edge of a lighter (not shown). Embodiments of the lighter frame 330 can have a diameter (or vertical height) between 1 and 10 cm, between 2 and 8 cm, and between 3 and 6 cm. The lighter frame 330, and the cigar holder 300 generally, are configured to attach, hold, or be affixed to a lighter (not shown).

Figure 4:
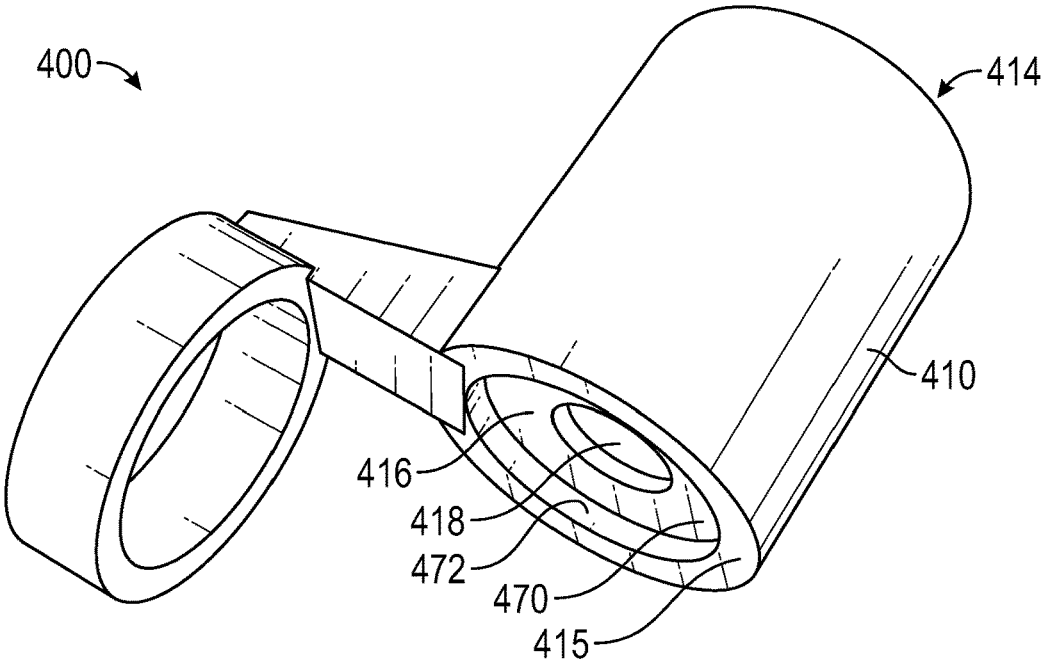
FIG. 4 illustrates a cigar holder, according to an embodiment.

FIG. 4 illustrates a perspective bottom view of a cigar holder 400, according to an embodiment. The cigar holder 400 depicted in FIG. 4 illustrates a gap, aperture or recess 470. The cigar tube recess 470 can be disposed at the bottom of the cigar tube 410 and is configured to reduce heat transfer from a lit cigar (not shown) to the lighter (not shown). The cigar tube recess 470 allows the cigar to breathe and allows heat to rise from a lit cigar. The cigar tube recess 470 can be recessed between 0.1 and 2 cm, between 0.25 and 1 cm, and between 0.5 and 0.75 cm from a lower cigar tube edge 415. The cigar tube recess 470 is defined by a cigar tube recess wall 472 and the cigar tube base 416. The cigar tube base 416 further includes the cigar tube base aperture 418. The cigar tube recess wall 472 can be an extension of the cigar tube inner wall 414 or it can be a separate configuration with a different shape and/or diameter.

Figure 5:
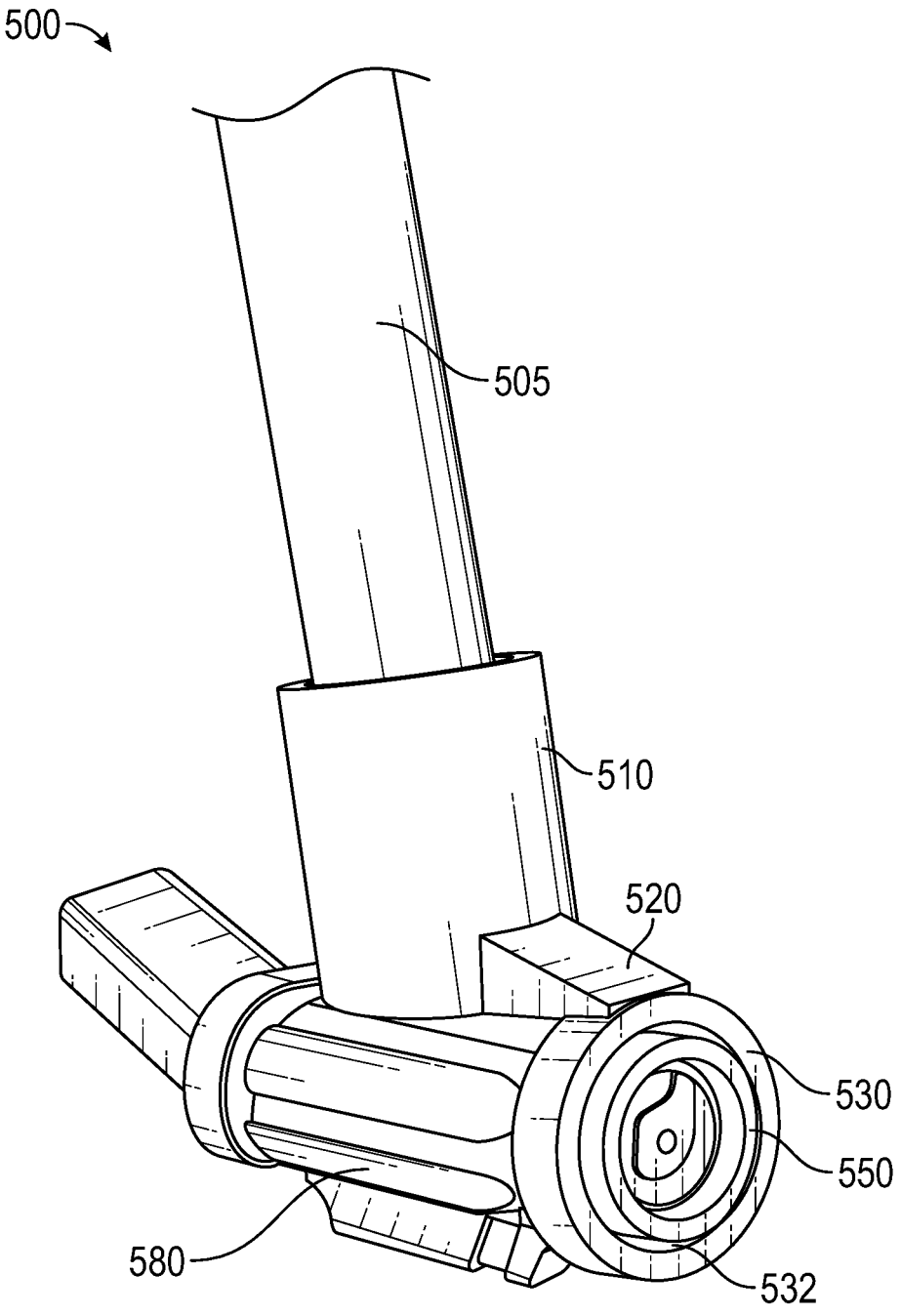
FIG. 5 illustrates a cigar holder, according to an embodiment.

FIG. 5 illustrates a cigar holder 500 with a magnet 550, according to an embodiment. The cigar holder 500 depicted in FIG. 5 includes the magnet 550, a lighter 580, and a cigar 505. The magnet can be a high-powered magnet, such as ceramic, ferrite, aluminum nickel, aluminum nickel cobalt, samarium cobalt, or neodymium iron boron. The magnet 550 is configured to secure the cigar holder 500 to a metal structure or vehicle, and to hold the cigar holder 500 in place during movement, turbulence, shaking, and other motions. The magnet 550 is further configured to not interfere with the ignitor control switch or the butane/propane refill mechanism of the lighter 580. Embodiments of the magnet 550 can be configured in a circular shape and occupy an edge portion 532 of the lighter frame 530. The location of the magnet 550 in the lighter frame edge portion 532 allows the cigar holder 500 to be secured to a structure (not shown) without interfering with the operation of the lighter 580.

FIG. 5 further depicts a cigar 505 being held in the cigar tube 510. The cigar 505 can be placed in the cigar tube 510 in a lit or an un-lit state. When the cigar 505 is stored in the cigar tube 510 the cigar 505 should be placed lit-side-up into the cigar tube 510. Generally, the cigar tube 510 is configured to hold standard to large cigars having a diameter between 1 and 2 cm. The inner diameter and the vertical height of the cigar tube 510 is designed to hold a cigar 505 in place when the cigar holder 500 has been attached to a moving vehicle, such as a car, boat or golf cart. The cigar tube 510 is configured to hold the cigar 505 even under turbulent conditions, such as hills, uneven ground, waves, bumpy roads, and similar impediments.

Figure 6:
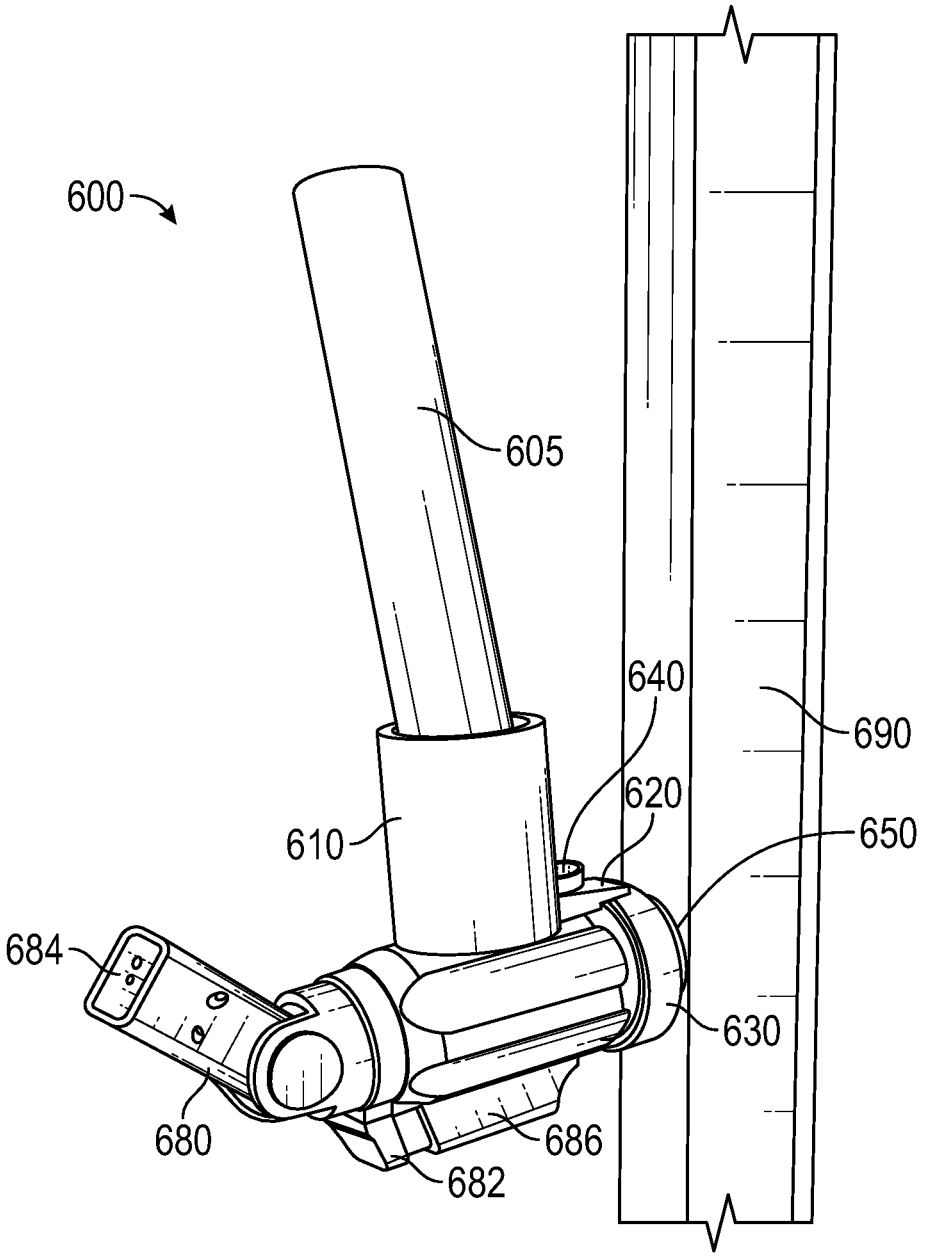
FIG. 6 illustrates a cigar holder, according to an embodiment.

FIG. 6 illustrates a cigar holder 600 including a magnet 650 attached to a metal pole 690, according to an embodiment. The cigar holder 600 depicted in FIG. 6 includes a cigar 605, a lighter 680, and a structure 690. The cigar holder 600 depicted in FIG. 6 allows a user to store the cigar 605 (in the lit or unlit state) in the cigar tube 610. The cigar holder 600 attached to the structure 690 via the magnet 650 (not shown) allows the user to light the cigar 605 via the lighter 680 without separating the lighter 680 from the cigar holder 600. Further, the ignitor control switch 682, the flame output 684, and the fuel compartment 686 are not obstructed by the cigar holder 600.

FIG. 6 further illustrates a punch 640 located on the attachment arm 620. When the cigar holder 600 is secured via the magnet 650 to a structure 690, a user can employ the punch 640 to perforate an edge of a cigar 605 allowing the cigar 605 to be lit more efficiently.

The cigar holder 600 can be prepared from metals, ceramics, plastics, or other non-flammable and non-melting materials. The cigar holder 600 can be prepared from materials that will not deform, melt, or ignite when in contact with a lit cigar.

The lighter 680 can be affixed, secured, or attached to the cigar holder 600. The lighter 680 can be attached via adhesive or secured to the cigar holder 600 via the configuration of the underside of the cigar holder 600 and the lighter frame 630. Securing means, such as tabs, screws, bolts, clips, or other securing means can be used to attach the lighter 680 to the cigar holder 600.

The magnet 650 can be affixed to the lighter frame edge 632 via adhesive, welding, bolts, screws, or other attaching means.

Figure 7:
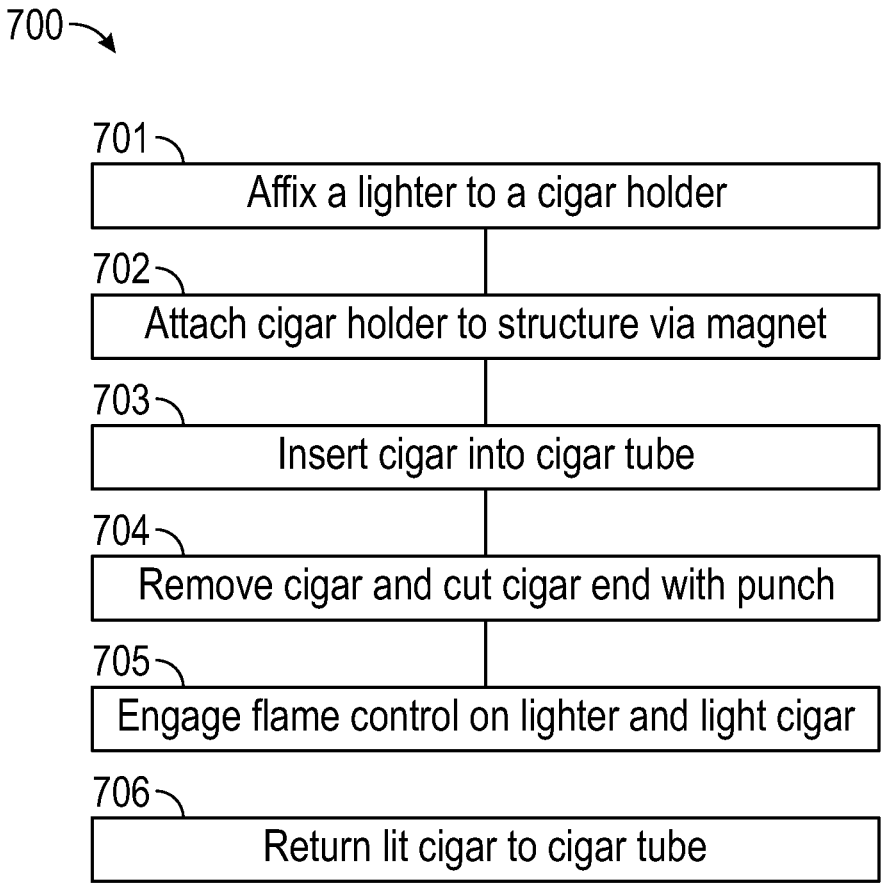
FIG. 7 illustrates a block flow chart for a method employing a cigar holder, according to an embodiment.

FIG. 7 illustrates a block chart 700 of a method of using the cigar holder. In step 701 the user affixes a lighter to the cigar holder. In step 702 the user attaches the cigar holder to a structure via a magnet affixed to the cigar holder. In step 703 the user inserts a cigar into the cigar tube of the cigar holder. In step 704 the user removes the cigar from the cigar tube and cuts an end of the cigar with the punch. In step 705 the user engages the ignitor control switch on the lighter and lights the cigar. In step 706 the user returns the lit cigar into the cigar tube.

Embodiments of the cigar holder include a cigar tube, wherein the cigar tube has a cylindrical geometry, a cigar tube outer wall, a cigar tube inner wall, a cigar tube base, and a cigar tube base aperture, and a cigar tube recess. The cigar tube recess is disposed on a bottom edge of the cigar tube and defined by a cigar tube recess wall. Embodiments of the cigar holder include an attachment arm, wherein the attachment arm includes an attachment arm base, an attachment arm edge, and a punch. Embodiments of the cigar holder further include a lighter frame, wherein the lighter frame includes a lighter frame edge, and a magnet. The attachment arm base connects the attachment arm to the cigar tube, and the attachment arm edge connects the attachment arm to the lighter frame. The lighter frame is configured to receive a lighter, and the magnet is configured to affix the cigar holder to a structure.

Embodiments of the cigar holder include a lighter selected from the group consisting of butane lighters, propane lighters, torch lighters, soft flame lighters, plasma lighters, and electric lighters, and the magnet is selected from the group consisting of ceramic, ferrite, aluminum nickel, aluminum nickel cobalt, samarium cobalt, or neodymium iron boron.

Embodiments of the cigar holder include the lighter permanently affixed to the cigar holder, and the lighter is a torch lighter.

Embodiments of the cigar holder include the lighter is non-permanently affixed to the cigar holder, and the magnet is a high-powered neodymium iron boron magnet.

Embodiments of the cigar tube recess are configured to allow heat from a lit cigar to escape the cigar tube and reduce heat transfer from the cigar to the lighter.

Embodiments of the cigar holder are configured to attach to a moving vehicle via the magnet, and the cigar tube is configured to retain a cigar during operation of the vehicle.

Embodiments of the punch is configured to cut an end portion of a cigar, and not perforate human skin.

Embodiments of the punch are configured in a shape selected from circles, squares, rectangles, diamonds, triangles, stars, and combinations thereof.

Embodiments include methods including affixing a lighter to a cigar holder, wherein the cigar holder comprises a cigar tube, an attachment arm, and a lighter frame; attaching the cigar holder to a structure via a magnet affixed to the cigar holder, wherein the magnet is permanently attached to the lighter frame and or lighter; inserting a cigar into the cigar tube of the cigar holder; removing the cigar from the cigar tube and cutting an end of the cigar on a punch, wherein the punch is disposed on the attachment arm of the cigar holder; engaging a ignitor control switch on the lighter and lighting the cigar; returning the lit cigar to the cigar tube.

Embodiments include methods where the lighter is permanently affixed to the cigar holder; and the punch is configured in a circular shape.

Embodiments include methods the structure is a land vehicle, and the cigar holder is configured to retain a cigar in the cigar tube while the vehicle is in motion.

Embodiments include methods where the structure is a water vehicle, and the cigar holder is configured to retain a cigar in the cigar tube while the water is subject to wave motion.

Embodiments include methods where the lighter is permanently affixed to the cigar holder, and the magnet is removably attached to the structure.

Embodiments include methods the magnet is a high-powered is neodymium iron boron magnet, the lighter is a butane torch lighter, and the cigar holder is prepared from a heat resistant plastic or metal.

Embodiments include methods where the punch has a raised circular geometry, and the punch is disposed on the attachment arm in an upright vertical position.

Embodiments include a cigar holder including a cigar tube with a cylindrical geometry, an attachment arm, a lighter frame, and a magnet. In embodiments the attachment arm connects the cigar tube and the lighter frame, the lighter frame is configured to receive a lighter, and the magnet is configured to affix the cigar holder to a structure.

Embodiments further include the cigar tube including a cigar tube base, a cigar tube base aperture, and a cigar tube recess, wherein the cigar tube recess is configured to reduce heat transfer to the lighter.

Embodiments include a punch with a square geometry, and wherein the punch is disposed on the attachment arm in a raised vertical position.

Embodiments include a magnet configured to be removably affixed to a frame of a golf cart, and a cigar tube configured to retain the cigar while the golf cart is in motion.

Embodiments include the lighter permanently affixed to the cigar holder, the cigar holder configured to be removably affixed to a frame of a boat, and the cigar tube configured to retain the cigar while the boat is subject to wave motion.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C. and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A device, comprising:

a cigar holder comprising:
- a cigar tube,
  - wherein the cigar tube:
    - has a cylindrical geometry,
    - a cigar tube outer wall,
    - a cigar tube inner wall,
    - a cigar tube base,
    - a cigar tube base aperture, and
    - a cigar tube recess,
      - wherein the cigar tube recess is disposed on a bottom edge of the cigar tube and defined by a cigar tube recess wall;
- an attachment arm,
  - wherein the attachment arm comprises:
    - an attachment arm base,
    - an attachment arm edge, and
    - a punch,
- a lighter frame,
  - wherein the lighter frame comprises:
    - a lighter frame edge, and
    - a magnet,
- wherein:
  - the attachment arm base connects the attachment arm to the cigar tube, and the attachment arm edge connects the attachment arm to the lighter frame,
  - the lighter frame is configured to receive a lighter, and
  - the magnet is configured to affix the cigar holder to a structure.

2. The device of claim 1, wherein:
the lighter is selected from the group consisting of butane lighters, propane lighters, torch lighters, soft flame lighters, plasma lighters, and electric lighters; and
the magnet is selected from the group consisting of ceramic, ferrite, aluminum nickel, aluminum nickel cobalt, samarium cobalt, or neodymium iron boron.

3. The device of claim 2, wherein:
the lighter is permanently affixed to the cigar holder, and
the lighter is a torch lighter.

4. The device of claim 2, wherein:
the lighter is non-permanently affixed to the cigar holder, and
the magnet is a high-powered neodymium iron boron magnet.

5. The device of claim 1, wherein the cigar tube recess is configured:
to allow heat from a lit cigar to escape the cigar tube, and
reduce heat transfer from the cigar to the lighter.

6. The device of claim 1, wherein:
the cigar holder is configured to attach to a moving vehicle via the magnet, and
the cigar tube is configured to retain a cigar during operation of the vehicle.

7. The device of claim 1, wherein the punch is configured:
to cut an end portion of a cigar, and
not perforate human skin.

8. The device of claim 7, wherein the punch is configured in a shape selected from circles, squares, rectangles, diamonds, triangles, stars, and combinations thereof.

9. A device, comprising: a cigar holder comprising: a cigar tube with a cylindrical geometry, an attachment arm, a lighter frame, a punch, and a magnet, wherein: the attachment arm comprises a base that connects the attachment art to the cigar tube and an edge that connects the attachment art to the lighter frame, the lighter frame is configured to receive a lighter, and the magnet is configured to affix the cigar holder to a structure.

10. The device of claim 9, wherein:
the cigar tube further comprises:
a cigar tube base,
a cigar tube base aperture, and
a cigar tube recess,
wherein the cigar tube recess is configured to reduce heat transfer to the lighter.

11. The device of claim 9, wherein:
the punch has a square geometry, and
the punch is disposed on the attachment arm in a raised vertical position.

12. The device of claim 9, wherein:
the magnet is configured to be removably affixed to a frame of a golf cart, and
the cigar tube is configured to retain the cigar while the golf cart is in motion.

13. The device of claim 9, wherein:
the lighter is permanently affixed to the cigar holder,
the cigar holder is configured to be removably affixed to a frame of a boat, and
the cigar tube is configured to retain the cigar while the boat is subject to wave motion.

14. A device, comprising:
a cigar holder comprising:
a cigar tube with a cylindrical geometry,
an attachment arm,
a lighter frame,
a punch, wherein:
the punch is disposed on the attachment arm of the cigar holder, and
the punch is configured to cut an end of the cigar on,
a magnet, wherein the magnet is permanently attached to the lighter frame,
wherein:
the attachment arm connects the cigar tube and the lighter frame,
the lighter frame is configured to receive a lighter,
the magnet is configured to affix the cigar holder to a structure,
the cigar holder is configured to receive a lighter, wherein:
the cigar holder is configured to receive a cigar into the cigar tube;
the lighter comprises an ignitor configured to light the cigar; and
the cigar tube is configured to hold the cigar that has been lit.

15. The device of claim 14, wherein:
the lighter is permanently affixed to the cigar holder; and
the punch is configured in a circular shape.

16. The device of claim 14, wherein:
the structure is a land vehicle, and
the cigar holder is configured to retain a cigar in the cigar tube while the vehicle is in motion.

17. The device of claim 14, wherein:
the structure is a water vehicle, and
the cigar holder is configured to retain a cigar in the cigar tube while the water is subject to wave motion.

18. The device of claim 14, wherein:
the lighter is permanently affixed to the cigar holder, and
the magnet is removably attached to the structure.

19. The device of claim 18, wherein:
the magnet is a high-powered is neodymium iron boron magnet,
the lighter is a butane torch lighter, and
the cigar holder is prepared from a heat resistant metal or plastic.

20. The device of claim 14, wherein:
the punch has a raised circular geometry, and
the punch is disposed on the attachment arm in an upright vertical position.

* * * * *